US005765683A

United States Patent [19]

Starkle

[11] Patent Number: 5,765,683

[45] Date of Patent: Jun. 16, 1998

[54] MIRRORED LIPSTICK CASE ATTACHMENT

[76] Inventor: Michael Starkle, 1216 ½ S. Ash Ave., Tempe, Ariz. 85281

[21] Appl. No.: 677,973

[22] Filed: Jul. 10, 1996

[51] Int. Cl.[6] ..... B65D 85/72

[52] U.S. Cl. ..... 206/385; 220/803; 206/581; 206/235

[58] Field of Search ..... 220/803, 8, 804, 220/805, 806; 206/385, 581, 235

[56] References Cited

U.S. PATENT DOCUMENTS

| | | | |
|---|---|---|---|
| 1,490,845 | 4/1924 | Music . | |
| 1,655,452 | 1/1928 | Ament . | |
| 2,234,485 | 3/1941 | Connor | 220/803 |
| 3,231,078 | 1/1966 | Balocca et al. | 220/803 |
| 4,905,128 | 2/1990 | Caires . | |
| 5,257,696 | 11/1993 | Greene . | |
| 5,346,088 | 9/1994 | Brimo, II | 220/803 |

*Primary Examiner*—Joseph M. Moy
*Attorney, Agent, or Firm*—Frishauf, Holtz, Goodman, Langer & Chick

[57] ABSTRACT

A lipstick case attachment for securing a mirror-quality reflective surface on a lipstick case. The lipstick case attachment includes a housing shaped to longitudinally engage a lipstick case. A lip is formed along an inner peripheral surface of the housing at an upper end of the housing, and a mirror having a mirror-quality reflective surface is arranged in the housing to abut against the lip of the housing to be held therein. An elastomeric gripping member is arranged on an interior surface of the housing. The elastomeric gripping member is compressible upon engagement of the housing with a lipstick case so as to frictionally grip the lipstick case and secure the lipstick case attachment thereto.

17 Claims, 2 Drawing Sheets

MIRRORED LIPSTICK CASE ATTACHMENT

BACKGROUND OF THE INVENTION

The present invention relates to a device which enables lipstick users to see their lips when applying a cosmetic and to examine their lips after applying the cosmetic to ensure that the cosmetic has been cleanly and consistently applied. Manufacturers of lipstick rarely provide a mirror-quality reflective surface on the lipstick case. External mirrors such as those found in restrooms and automobiles are not always conveniently available. Use of external mirrors associated with other products such as a cosmetic compact is not always practical or desirable, giving rise to a need for a mirror-quality reflective surface that is attachable to a lipstick case.

SUMMARY OF THE INVENTION

It is an object of the present invention to provide a lipstick case attachment having a mirror-quality reflective surface.

It is another object of the present invention to provide a lipstick case attachment which is interchangeably attachable to a variety of different lipstick cases.

It is still another object of the present invention to provide a lipstick case attachment which adds little bulk to the underlying lipstick case so that a lipstick case having the lipstick case attachment attached thereto fits easily into even the smallest of purses or carrying cases.

It is yet another object of the present invention to provide a lipstick case attachment which follows the basic design of the underlying case so that the lipstick case attachment does not detract from the aesthetic appeal of the underlying case.

In order to achieve the above objects, the lipstick case attachment of the present invention comprises a housing shaped to longitudinally engage a lipstick case. A lip is formed along an inner peripheral surface of the housing at an upper end of the housing, and a mirror having a mirror-quality reflective surface is arranged in the housing to abut against the lip of the housing to be held therein. An elastomeric gripping member is arranged on an interior surface of the housing. The elastomeric gripping member is compressible upon engagement of the housing with a lipstick case so as to frictionally grip the lipstick case and secure the lipstick case attachment thereto.

DETAILED DESCRIPTION

Figure 1:
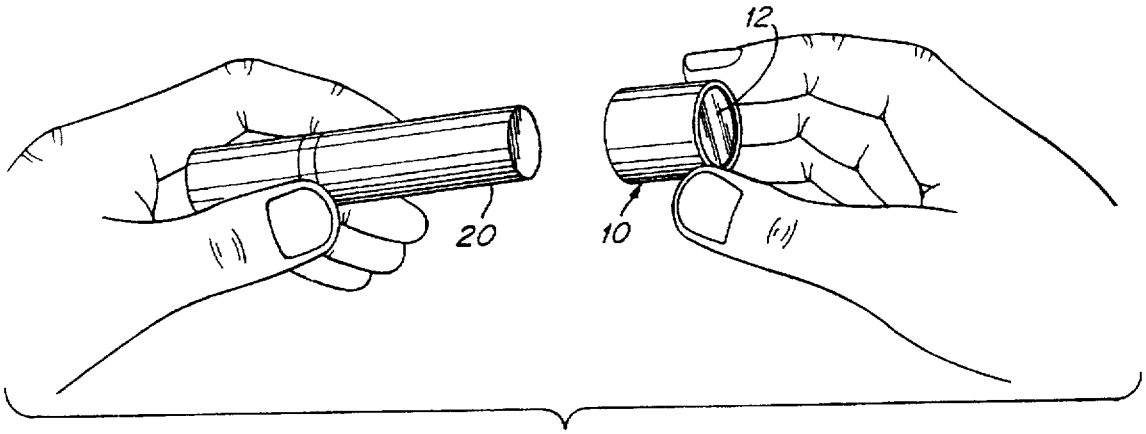
FIG. 1 is a perspective view showing the mirrored lipstick case attachment of the present invention in a ready position to be attached to a lipstick case.

FIG. 1 is a perspective view showing the mirrored lipstick case attachment 10 in a ready position to be attached to a lipstick case 20.

Figure 2:
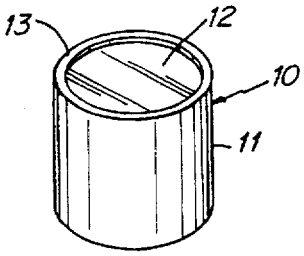
FIG. 2 is a front, top perspective view showing the mirrored lipstick case attachment of the present invention.
Figure 3:
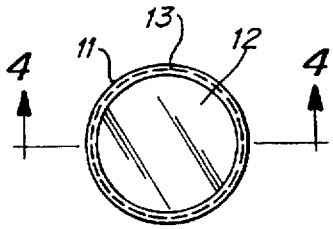
FIG. 3 is a top plan view of the mirrored lipstick case attachment of the present invention.

As shown in FIGS. 2 and 3, the mirrored lipstick case 10 includes an outer housing 11 and a mirror 12. The housing 11 is integrally provided with a lip 13 at one end thereof against which mirror 12 may be held in place. Mirror 12 may be permanently affixed to the integral lip 13 of housing 11 by applying an appropriate adhesive, such as a hot melt glue, to the outer edges of the mirror.

The housing 11 is constructed to have a shape generally similar to that of the underlying lipstick case 20. Typically, the housing 11 will be generally cylindrical in shape, but it may also be hexagonal or any other shape matching that of the underlying lipstick case 20. In a preferred embodiment, housing 11 is approximately 0.9" in length and approximately 0.9" in diameter, and has a thickness of approximately 0.015". The housing 11 is preferably made of anodized aluminum to have walls which are as thin as possible, but may also be made of plastic.

The mirror 12 has a diameter of approximately 0.85", and when inserted into the housing 11 against lip 13, mirror 12 has an exposed reflective surface having a diameter of approximately 0.8". The mirror may be of a standard or magnifying nature.

Figure 4:
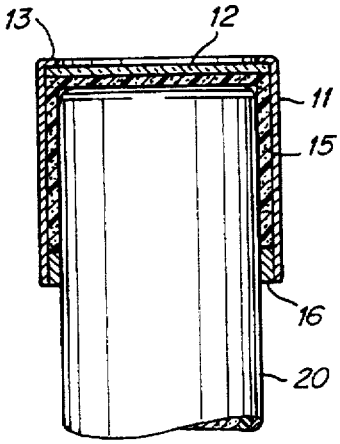
FIG. 4 is an enlarged sectional view, taken along line 4—4 in FIG. 3, of the mirrored lipstick case attachment of the present invention attached to a lipstick case.

FIG. 4 shows an enlarged cross section of the mirrored lipstick case attachment 10 attached to the lipstick case 20 via an elastomeric gripping member 15 and sealing ring 16.

Figure 5:
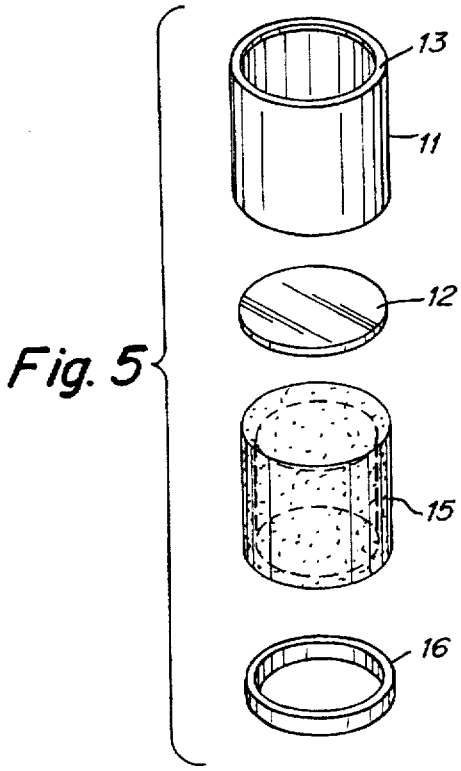
FIG. 5 is an exploded view of the mirrored lipstick case attachment of the present invention showing an outer housing, a mirror, an elastomeric gripping member, and a sealing ring.

FIG. 5 shows an exploded view of the mirrored lipstick case attachment 10 with all of its components shown separately. Such components include the housing 11 with integral lip 13 and mirror 12 described hereinabove, and the elastomeric gripping member 15 and sealing ring 16 described in further detail hereinbelow.

The lipstick case attachment 10 is slidable over a lipstick case 20 such that the elastomeric gripping member 15 is compressed to secure the lipstick case attachment 10 on the lipstick case 20 by frictional force. Depending on the relative dimensions of the lipstick case 20, lipstick case attachment 10 and elastomeric gripping member 15, the elastomeric gripping member 15 may be compressed more or less to appropriately secure the lipstick case attachment 10 on a given lipstick case 20.

The elastomeric gripping member 15 is designed to fit snugly on the interior of housing 11. The elastomeric gripping member 15 may frictionally engage both the inner surface of the housing 11 and the outer surface of a lipstick case 20 when it is compressed therebetween. Alternatively, the elastomeric gripping member 15 may be permanently affixed to the interior of housing 11 with an appropriate adhesive, such as a hot melt glue.

The elastomeric gripping member 15 is of a shape that generally conforms to the interior of housing 11. In a preferred embodiment, the elastomeric gripping member 15 is approximately 0.08" thick. The elastomeric gripping member 15 may also be tapered such that it is approximately 0.08" thick at the top of housing 11 (near mirror 12) and approximately 0.03" at the bottom of housing 11 (near sealing ring 16). The elastomeric gripping member 15 shown in FIGS. 4 and 5 has a generally cylindrical shape, but it may also have any other shape which enables it to fit snugly between the housing 11 and the lipstick case 20 so as to frictionally secure the lipstick case attachment 10 on the lipstick case 20.

The elastomeric gripping member 15 is made of an elastomeric rubber or similar flexible material or compound. The flexible nature of the elastomeric gripping member 15 enables the lipstick case attachment 10 to be interchangeably attached to lipstick cases 20 of a range of sizes.

Sealing ring 16 may be made of anodized aluminum, is shaped to fit snugly on the interior of housing 11 at its base, and may be permanently affixed in housing 11 by means of an appropriate adhesive, such as a hot melt glue. Sealing ring 16 serves two purposes. It serves a cosmetic purpose by providing a finished appearance to the lower end or base of attachment 10. In addition, it serves a protective purpose by preventing the user from forcefully inserting a lipstick case 20 that is so large as to potentially tear or damage elastomeric gripping member 15. Thus, sealing ring 16 prevents the lipstick case attachment 10 from being attempted to be attached to outsized lipstick cases 20 that will excessively compress the elastomeric gripping member 15, thereby preventing potential damage and/or permanent disfiguration of the elastomeric gripping member 15. The lipstick case attachment 10, elastomeric gripping member 15 and sealing ring 16 of the present invention are nonetheless appropriately sized so as to be suitable for use with a wide range of sizes of lipstick cases 20.

It should be appreciated that the lipstick case attachment 10 is preferably detachably secured on the lipstick case 20. As described hereinabove, the lipstick case attachment 10 is preferably secured on the lipstick case 20 by the frictional force provided by the elastomeric gripping member 15 which may include compression of the elastomeric gripping member 15. This frictional force provides a non-permanent attachment whereby the lipstick case attachment 10 can be pulled off or removed from the lipstick case 20 (for example, by twisting) and may then be re-used on another lipstick case 20. Alternatively, the lipstick case attachment 10 can be permanently attached to a lipstick case 20 for single use therewith by means of, for example, an adhesive.

It should also be appreciated that the lipstick case attachment 10 is preferably sized to achieve a minimal size differential to the lipstick case 20. Accordingly, the lipstick case attachment 10 adds little bulk to the underlying lipstick case 20 so that a lipstick case 20 having the lipstick case attachment 10 attached thereto fits easily into even the smallest of purses or carrying cases.

It should further be appreciated that the lipstick case attachment 10 is preferably designed to match a variety of basic designs of underlying lipstick cases 20, both in color and in shape, so that the lipstick case attachment 10 does not detract from the aesthetic appeal of the underlying lipstick cases 20.

Figure 6:
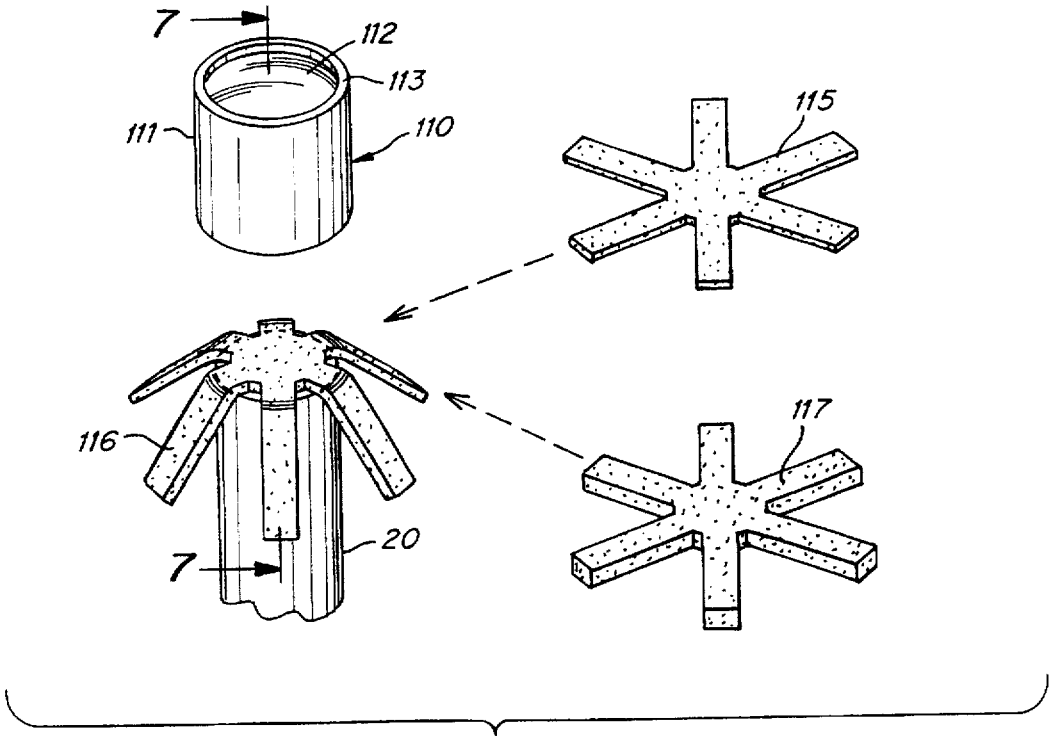
FIG. 6 is an exploded perspective view of an alternate embodiment of the mirrored lipstick case attachment of the present invention.

FIG. 6 shows an exploded perspective view of an alternate embodiment of the mirrored lipstick case attachment 110 of the present invention. A plurality of interchangeable elastomeric gripping members 115, 116 and 117 of varying thickness are provided for securing the mirrored lipstick case attachment 110 to lipstick cases 20 of varying size. The appropriate one of elastomeric gripping members 115, 116 and 117 is placed on top of the lipstick case 20 as shown in FIG. 6, and the mirrored lipstick case attachment 110 is then slid thereover such that the selected one of elastomeric gripping members 115, 116 and 117 is compressed to secure the lipstick case attachment 110 to the lipstick case 20 by frictional force. The elastomeric gripping members 115, 116 and 117 may be generally star shaped with a plurality of legs extending from a central portion, as shown in FIG. 6. The elastomeric gripping members 115, 116 and 117 may have thicknesses of approximately 0.03", 0.08" and 0.13", respectively, for fitting the lipstick case attachment 110 to large, medium and small sized lipstick cases 20, respectively. Also as shown in FIG. 6, the lipstick case attachment 110 may be provided with a convex mirror 112 for increasing the reflected visible area of a user's lips. Such a convex mirror arrangement could also be used in place of the flat mirror of the lipstick case attachment 10 shown in FIGS. 1–5.

Figure 7:
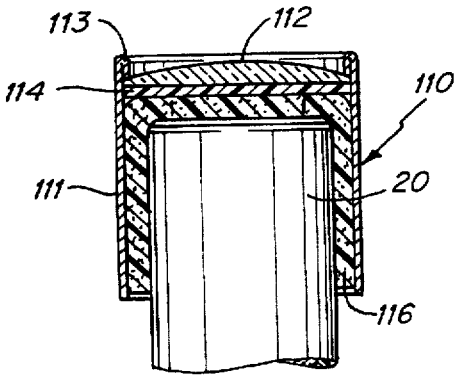
FIG. 7 is an enlarged sectional view, taken along line 7—7 in FIG. 6, of the alternate embodiment of the mirrored lipstick case attachment shown in FIG. 6 attached to a lipstick case.

FIG. 7 is an enlarged sectional view, taken along line 7—7 in FIG. 6, of the alternate embodiment of the mirrored lipstick case attachment 110 shown in FIG. 6 attached to a lipstick case 20. As shown in FIG. 7, the selected elastomeric gripping member 116 is compressed to secure the lipstick case attachment 110 by frictional force. Also as shown in FIG. 7, a plastic retaining disk 114 may be interposed between the mirror 112 and the selected one of elastomeric gripping members 115, 116 and 117 for securing the mirror 112 in the housing 111 of the lipstick case attachment 110. The mirror 112 is secured at its upper surface by the peripheral lip 113 of the housing 111. The plastic retaining disk 114 may be friction fitted or adhesively secured by, for example, a hot melt glue. The sealing ring 16 of the lipstick case attachment 10 shown in FIGS. 4 and 5 is omitted in the embodiment of FIGS. 6 and 7. However, such a sealing ring 16 may be provided, for example, by lengthening the housing 111 or shortening the legs of elastomeric gripping members 115, 116 and 117.

Figure 8:
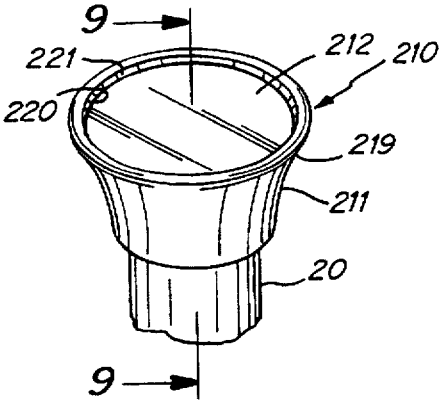
FIG. 8 is a front, top perspective view showing another alternate embodiment of the mirrored lipstick case attachment of the present invention.
Figure 10:
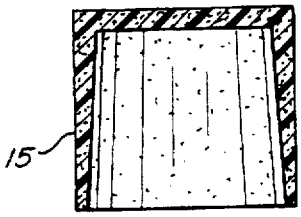
FIG. 10 is an enlarged sectional view of a tapered elastomeric gripping member.

FIG. 8 is a front, top perspective view showing another alternate embodiment of the mirrored lipstick case attachment 210 of the present invention. As shown in FIG. 8, the housing 211 is outwardly flared or tapered at its top end 219 so as to accommodate therein an enlarged mirror 212. The enlarged mirror 212 may have a diameter of approximately 1.25" to thereby increase the size of the reflected view of a user's lips. The enlarged mirror 212 is held in place by being fit in a groove 220 of the outwardly flared upper portion of the housing 211. The entrance to the groove 220 may be provided with an inclined surface 221 so that the enlarged mirror 212 may be easily snapped into place.

Figure 9:
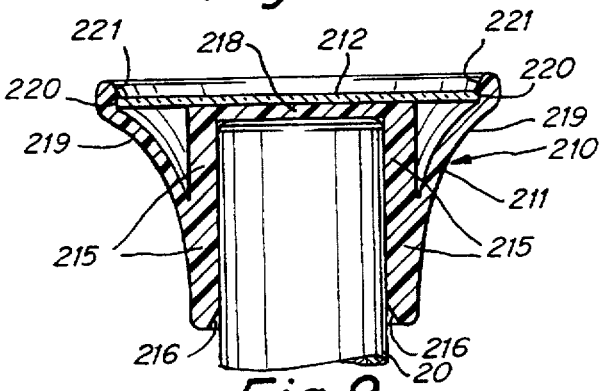
FIG. 9 is an enlarged sectional view, taken along line 9—9 in FIG. 8, of the alternate embodiment of the mirrored lipstick case attachment shown in FIG. 8 attached to a lipstick case.

FIG. 9 is an enlarged sectional view, taken along line 9—9 in FIG. 8, of the alternate embodiment of the mirrored lipstick case attachment 210 of the present invention shown in FIG. 8 attached to a lipstick case 20. As shown in FIG. 9, the elastomeric gripping member 215 comprises the side portion of the housing 211. The elastomeric gripping member 215 may be made of a soft plastic material which can be friction fitted onto a lipstick case 20. A tapered lead-in 216 may be formed at the end of the elastomeric gripping member 215 for more easily placing the housing 211 of the lipstick case attachment 210 over a lipstick case 20 to secure the lipstick case attachment 210 thereto. A top surface 218 of the lipstick case attachment 210 serves as a backing or support surface for the enlarged mirror 212. The entire elastomeric attachment 210, including the gripping member portion 215, the top surface 218 and the outwardly flared portion 219, is preferably molded as a single member.

Additional advantages and modifications will readily occur to those skilled in the art. Therefore, the invention in its broader aspects is not limited to the specific details, representative devices, and illustrated examples shown and described herein. Accordingly, various features of the respectively disclosed embodiments can be used with other embodiments, and various modifications may be made without departing from the spirit or scope of the general inventive concept of the present invention as defined by the appended claims and their equivalents.

I claim:

1. A lipstick case attachment for securing a mirror-quality reflective surface on a lipstick case, said lipstick case attachment comprising:

a housing shaped to longitudinally engage a lipstick case;

a mirror having a mirror-quality reflective surface, said mirror being affixed to said housing so as to be visible external of said housing; and an intermediate gripping member arranged on an interior surface of said housing, said intermediate gripping member being arranged between said housing and a lipstick case so as to engage the lipstick case and secure the lipstick case attachment to the lipstick case, and said intermediate gripping member being tapered in an uncompressed state such that a thickness thereof decreases from an upper end of said housing toward a lower end of is said housing.

2. The lipstick case attachment according to claim 1, wherein said lipstick case attachment is detachably securable to a lipstick case.

3. The lipstick case attachment according to claim 1, further comprising a sealing ring provided on the inner peripheral surface said housing at a lower end of said housing, said sealing ring preventing said housing from being engaged with an outsized lipstick case and thereby protecting said intermediate gripping member from damage.

4. The lipstick case attachment according to claim 3, wherein said lipstick case attachment is interchangeably detachably securable to lipstick cases having varying sizes, and said intermediate gripping member comprises an elastomeric gripping member which is compressible to appropriately secure said lipstick case attachment to said lipstick cases having varying sizes.

5. The lipstick case attachment according to claim 1, wherein said intermediate gripping member is permanently affixed to the interior surface of said housing.

6. The lipstick case attachment according to claim 1, wherein said intermediate gripping member is compressible upon engagement of said housing with a lipstick case so as to frictionally grip the lipstick case and secure the lipstick case attachment to the lipstick case.

7. The lipstick case attachment according to claim 1, wherein said housing has a lip integrally formed along an inner peripheral surface of an upper end of said housing, and said mirror is arranged in said housing to abut against said lip so as to be held in said housing.

8. The lipstick case attachment according to claim 7, wherein said mirror is permanently affixed in said housing so as to bear against said integrally formed lip.

9. The lipstick case attachment according to claim 1, wherein said housing member has one of a cylindrical or hexagonal shape.

10. The lipstick case attachment according to claim 1, wherein said intermediate gripping member is made of elastomeric material.

11. The lipstick case attachment according to claim 10, wherein said elastomeric gripping member is generally cylindrical in shape and approximately 0.08" thick.

12. The lipstick case attachment according to claim 10, wherein said elastomeric gripping member is generally cylindrical in shape and tapers from a thickness of approximately 0.08" at the upper end of said housing to a thickness of approximately 0.03" at the lower end of said housing.

13. The lipstick case attachment according to claim 1, wherein said housing is approximately 0.9" in length and approximately 0.9" in diameter and has walls having a thickness of approximately 0.015", said walls being made of one of anodized aluminum or plastic.

14. The lipstick case attachment according to claim 1, wherein said mirror has a diameter of approximately 0.85" and an exposed mirror-quality reflective surface of approximately 0.8" when inserted into said housing.

15. The lipstick case attachment according to claim 3, wherein said sealing ring is made of anodized aluminum.

16. The lipstick case attachment according to claim 1, wherein said mirror is a convex mirror for increasing a reflected visible area of a user's lips.

17. The lipstick case attachment according to claim 1, wherein said housing is outwardly flared at its upper end to accommodate a mirror having a diameter larger than the diameter of a lipstick case.

* * * * *

UNITED STATES PATENT AND TRADEMARK OFFICE

CERTIFICATE OF CORRECTION

PATENT NO. : 5,765,683

DATED : June 16, 1998

INVENTOR(S) : Michael STARKLE

It is certified that error appears in the above-identified patent and that said Letters Patent is hereby corrected as shown below:

On the Title page,

Item [56] References Cited,
under "U.S. PATENT DOCUMENTS" insert:

--2,039,323 5/1936 M.E. Lessin
2,121,221 6/1938 L.H. Fontan--.

Signed and Sealed this

Twenty-sixth Day of October, 1999

*Attest:*

*Attesting Officer*

Q. TODD DICKINSON

*Acting Commissioner of Patents and Trademarks*